US007540379B2

(12) United States Patent
Yau

(10) Patent No.: US 7,540,379 B2
(45) Date of Patent: Jun. 2, 2009

(54) INFORMATION BOOK WITH PDA AND MULTIPLE FOLDABLE PIECES

(75) Inventor: Yimwai Yau, Guangdong (CN)

(73) Assignees: Shenzhen Wang Ling Science and Technology Development Co., Ltd., Shenzhen, Guangdong (CN); Hung Yuen Industries Company, Ping Shan, Yuen Long, N.T. (HK)

( * ) Notice: Subject to any disclaimer, the term of this patent is extended or adjusted under 35 U.S.C. 154(b) by 386 days.

(21) Appl. No.: 11/579,840

(22) PCT Filed: Apr. 21, 2005

(86) PCT No.: PCT/CN2005/000550

§ 371 (c)(1),
(2), (4) Date: Nov. 7, 2006

(87) PCT Pub. No.: WO2005/108105

PCT Pub. Date: Nov. 17, 2005

(65) Prior Publication Data

US 2007/0199851 A1 Aug. 30, 2007

(30) Foreign Application Priority Data

May 9, 2004 (CN) ..... 2004 1 0027076

(51) Int. Cl.
*B42D 3/12* (2006.01)
*B42D 15/00* (2006.01)
*B42F 13/40* (2006.01)

(52) U.S. Cl. ..... 206/320; 206/701; 206/472; 206/486

(58) Field of Classification Search ..... 281/38, 281/15.1, 29; 446/147, 148; 40/762, 759, 40/737, 731, 726; 362/99, 98, 656, 658; 361/747, 686
See application file for complete search history.

(56) References Cited

U.S. PATENT DOCUMENTS

| | | | | |
|---|---|---|---|---|
| 5,109,354 | A * | 4/1992 | Yamashita et al. | 708/110 |
| 5,859,628 | A * | 1/1999 | Ross et al. | 345/173 |
| 6,379,070 | B1 * | 4/2002 | Butchma | 402/73 |
| 6,702,331 | B2 * | 3/2004 | Derraugh et al. | 281/38 |
| 6,806,867 | B1 * | 10/2004 | Arruda et al. | 345/173 |
| 6,889,057 | B2 * | 5/2005 | Tordera et al. | 455/557 |
| 6,961,237 | B2 * | 11/2005 | Dickie | 361/683 |
| 7,102,369 | B2 * | 9/2006 | Jung | 324/754 |
| 2002/0093813 | A1 * | 7/2002 | Thompson et al. | 362/98 |
| 2003/0012013 | A1 * | 1/2003 | Herrera | 362/99 |
| 2004/0233624 | A1 * | 11/2004 | Aisenberg | 361/683 |

* cited by examiner

*Primary Examiner*—Jacob K Ackun, Jr.
*Assistant Examiner*—Kaushikkumar Desai
(74) *Attorney, Agent, or Firm*—Raymond Y. Chan; David and Raymond Patent Firm

(57) ABSTRACT

An information book includes a booklet casing having a front cover, a back cover, and a middle panel foldably extended between the front and back covers. The front cover, middle panel, and back cover are adapted for overlappedly folding in a tri-fold manner and are adapted to be aligned edge-to-edge in a plane manner. The front cover has an inner indented side defining a receiving cavity therein such that the middle panel is fittedly received in the indented side of the front cover. The booklet casing further includes a binding element provided between the middle panel and the back cover along a folding line thereof for detachably binding at least an information sheet between the middle panel and the back cover. Therefore, information on the PDA and information 4on the information sheet are adapted to be read and used simultaneously.

10 Claims, 10 Drawing Sheets

A-A

INFORMATION BOOK WITH PDA AND MULTIPLE FOLDABLE PIECES

BACKGROUND OF THE PRESENT INVENTION

1. Field of Invention

The present invention relates to an information book for work and educational purposes, and more particularly to an information book with a PDA (Personal Data Assistant) which can store massive computer data, wherein the information book comprises a front cover detachably holding the PDA in position, a back cover overlappedly folding with the front cover and at least one middle panel foldably extended between the front and back covers in a tri-fold manner.

2. Description of Related Arts

PDA (Personal Data Assistant) becomes a common computer and data storage tool nowadays. There are many products on the market relating to PDA because they are small, easy to carry, and can carry massive amount of data. PDA is very popular nowadays because they satisfy the needs of the technology world nowadays. For work or educational purposes, people often use writing pad or folders. At the same time, they need to look up information on the computer or rely on computer computing power. It is inconvenient to carry the two or more tools and/or to use them at the same time. On the other hand, the conventional writing pad only has a front cover and a back cover with pages within for writing purposes. These conventional writing pads lack of creativity. As required to catch up with our technology world nowadays, people often have to carry a heavy bag to bring the information for work and educational purposes and it is very inconvenient.

SUMMARY OF THE PRESENT INVENTION

A main object of the present invention is to provide an information book with a PDA (Personal Data Assistant) and multiple foldable panels so that the user is capable to read and use the PDA information while writing or reading on the pages within the information book simultaneously without affecting each other's function. The information book offers a large storage capacity and is small in size for carrying conveniently.

Accordingly, in order to accomplish the above object, the present invention provides an information book comprising a booklet casing for retaining the PDA. The information booklet comprises a front cover for the PDA detachably mounting thereto, a back cover overlappedly folded to the front cover, and at least a middle panel foldably extended between the front and back covers in a tri-fold manner. The booklet casing is adapted to fold at a position that the front cover, the back cover and the middle panel are aligned edge-to-edge at a plane. The front cover has a receiving cavity formed on the corresponding side that the middle panel is adapted to fold in the receiving cavity of the front cover. The booklet casing further comprises a binding element provided along a folding line between the middle panel and the back cover to detachably binding a writing pad or writing sheets in an expandably replacing manner.

The middle panel comprises two pivot axes protruded from two corner edges of the middle panel, wherein the front cover has two corresponding pivot slots formed at upper and lower rims. The pivot axes are engaged with the pivot slots respectively to pivotally connect the middle panel with the front cover. A jointing strip is provided to connect edges of the middle panel and the back cover such that the middle panel is adapted to overlapped fold on the back cover. The jointing strip is made of flexible material for providing a soft folding connection between the middle panel and the back cover.

Alternatively, two jointing strips are used for folding connection that one of the jointing strips is connected between edges of the middle panel and the back cover while another jointing strip is connected between edge of the middle panel and the front cover.

The front cover has a hollow structure wherein a speaker is provided inside the front cover to electrically connect to the PDA.

The front cover further comprises a light source such as LED, mini light tube or light bulb for illumination purpose. The light source is electrically connected to a circuit board so as to provide light for the user to use the PDA and/or booklet casing under a dark environment. A power source, such as battery, is supported at the jointing strip to provide an electrical power for the booklet casing.

The front cover also has a computer communication terminal for connecting the PDA with any external computer devices.

The front cover further comprises a controlling keyboard which is electrically connected to the circuit board to allow a communication with the PDA.

The PDA is detachably mounted at the front cover. The front cover has a PDA window for the PDA fitting therewithin, wherein at least two pairs of PDA connectors are spacedly provided along an upper edge and a lower edge of the PDA window and a plurality of terminal slots spacedly provided on the top and bottom edges of the PDA to detachably engage with the PDA connectors. Accordingly, each of the PDA connectors has a resilient ability adapted to slidably move at the PDA window so as to detachably insert into the respective terminal slot of the PDA. Therefore, the PDA is adapted to detachably mount to the front cover within the PDA window via the PDA connectors. Each of the PDA connectors comprises an elongated mounting head, an elongated holding tail and an enlarged supporting base integrally extended between the mounting head and the holding tail. Accordingly, the supporting base and the holding tail are received in the window frame while a portion of the mounting head is protruded out of the window frame through a guiding slot thereof to slidably insert into the terminal slot of the PDA, so as to lock up the PDA within the PDA window. A plurality of metal made connector seats are mounted in the front cover wherein each of the connector seats has a seating slot aligning with the respective guiding slot of the PDA frame. A plurality of resilient elements are disposed in the seating slots of the connector seats respectively, wherein each of the resilient elements applies an urging force against the respective PDA connector to push the mounting heat thereof out of the window frame.

The present invention provides an integrated device combining a PDA and a note pad that an addition function is provided for expanding the use of PDA. Not only has it drastically increased the function and the amount of data that can be stored, but also make it more convenient for the user to use for various work or educational purposes. The present invention changes the structure design of the front and back covers of a conventional note pad and folder and offers a foldable middle panel which can be pulled out for usage or hidden when folded. The present invention can be expanded on a plane structure with the PDA mounted on the front cover for various using purposes. In addition, the present invention also has a light source and speaker integrated to connect with the PDA such that the user does not require to carry additional accessories in their travel.

BRIEF DESCRIPTION OF THE DRAWINGS

FIGS. 8A and 8B illustrate an alternative mode of the information book according to the above preferred embodiment of the present invention, wherein FIG. 8A illustrates the back cover overlapped on the middle panel and FIG. 8B illustrates the front cover, the back cover, and the middle panel are adapted for being folded at a plane position.

DETAILED DESCRIPTION OF THE PREFERRED EMBODIMENT

The following embodiment is shown and described for the purposes of illustrating the functional and structural principles of the present invention and is subject to change without departure from such principles. Therefore, this invention includes all modifications encompassed within the spirit and scope of the following claims.

Figure 1:
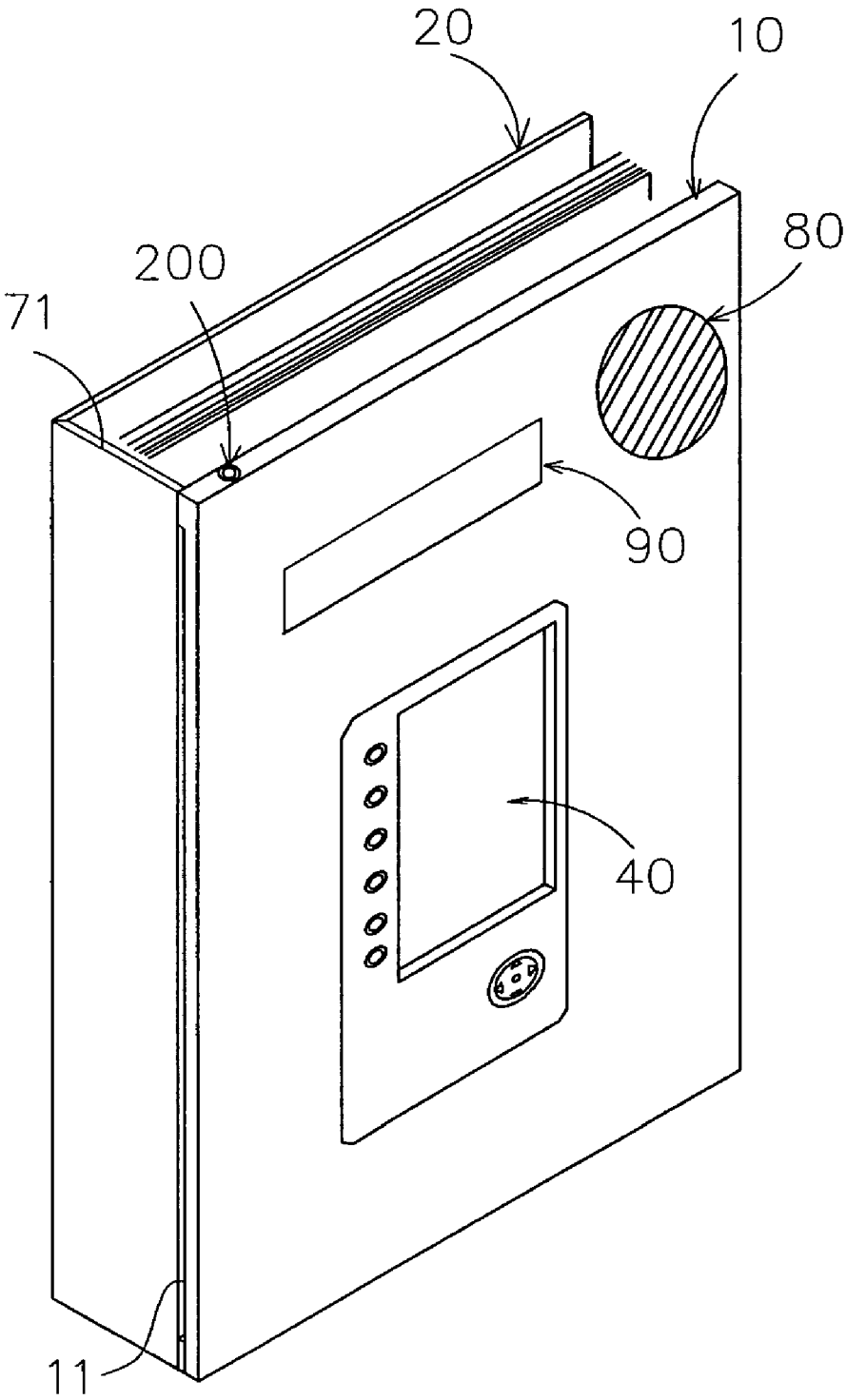
FIG. 1 is a perspective view of the information book according to a preferred embodiment of the present invention.
Figure 2A:
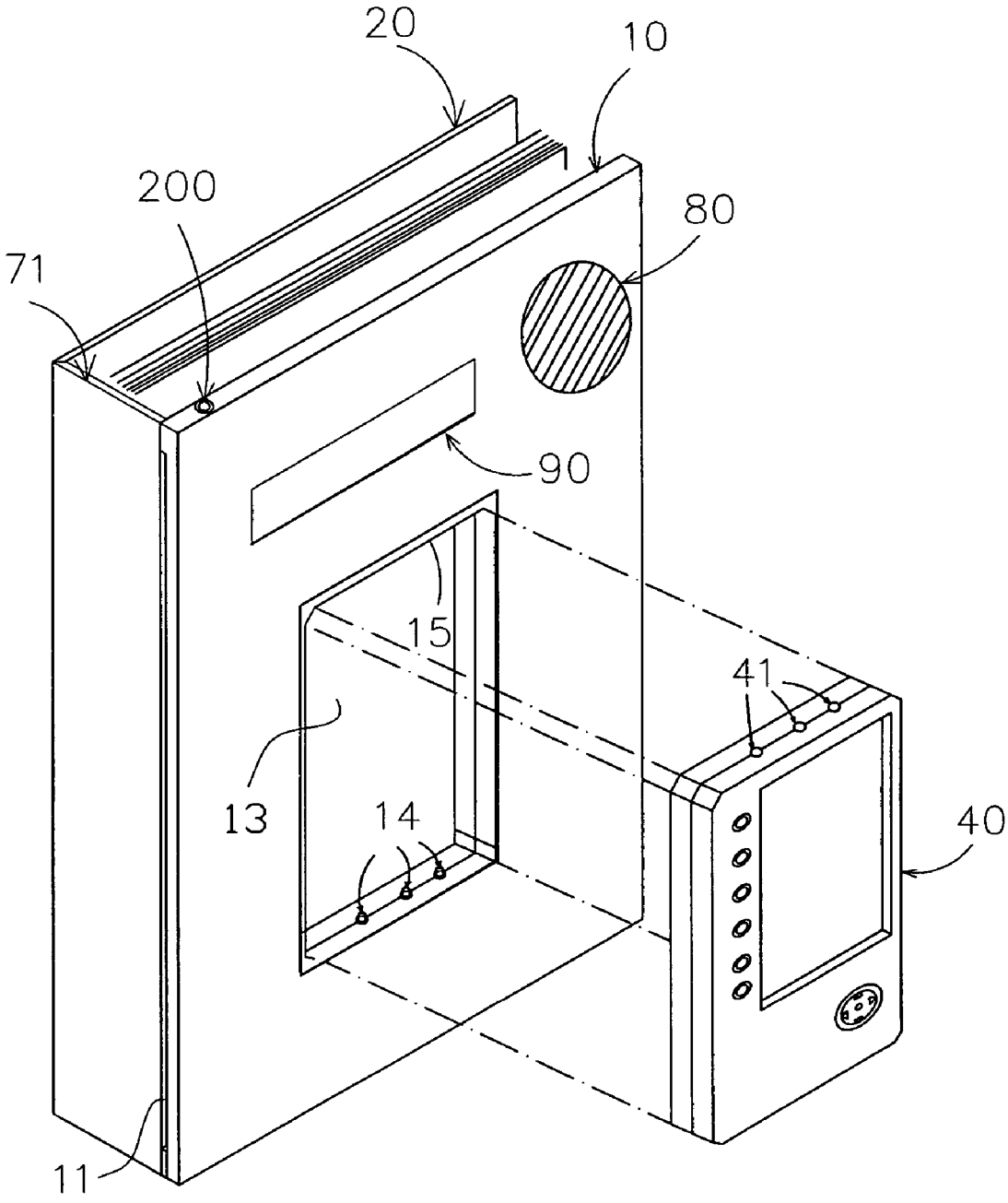
FIG. 2A is a perspective view of the information book according to the above mentioned preferred embodiment of the present invention, illustrating the mounting arrangement for detachably mounting the PDA to the front cover.
Figure 2C:
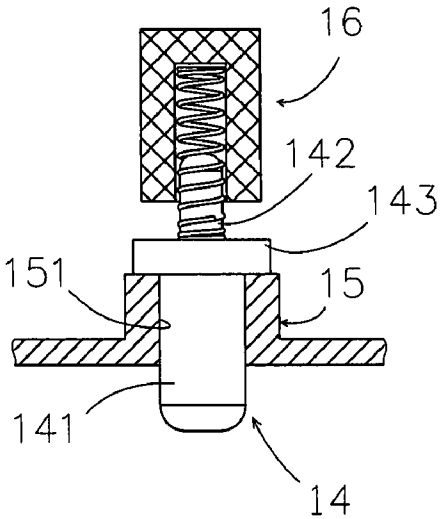
FIG. 2C is a cross sectional view of the PDA connector according to the above preferred embodiment of the present invention.
Figure 2B:
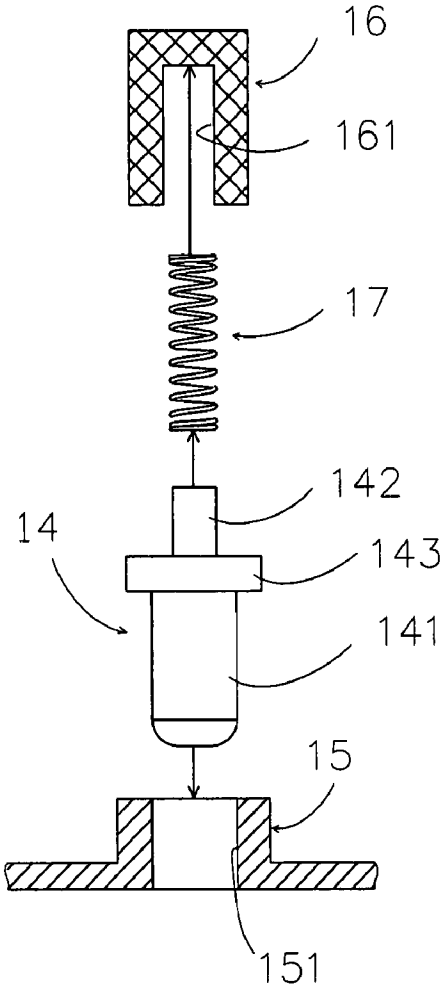
FIG. 2B is an exploded cross sectional view of the PDA connector according to the above mentioned preferred embodiment of the present invention.
Figure 3:
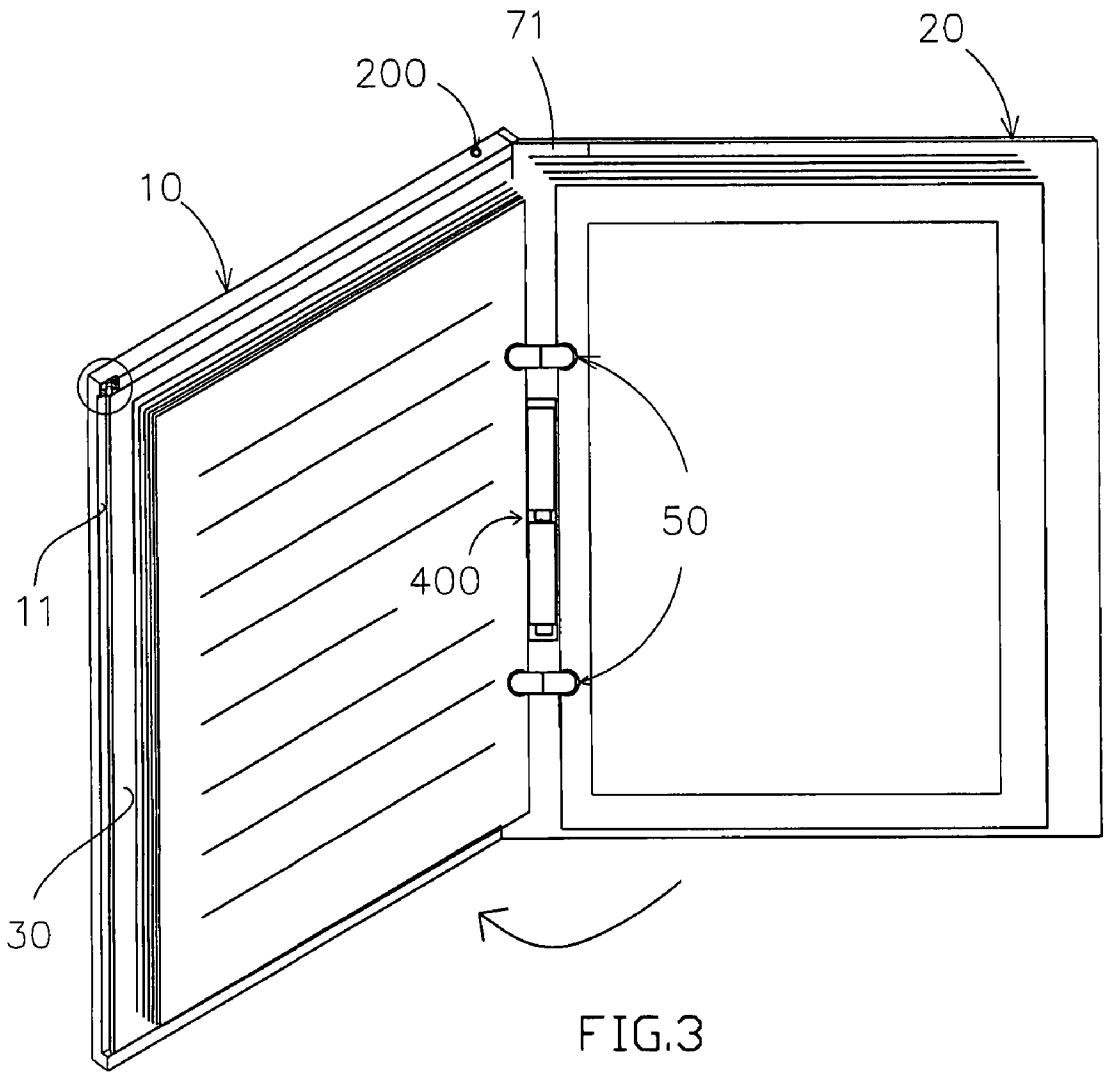
FIG. 3 is a perspective view of the information book according to the above preferred embodiment of the present invention, illustrating the middle panel being folded into the receiving cavity of the front cover and the binding element provided along the folding line between the middle panel and the back cover.
Figure 4:
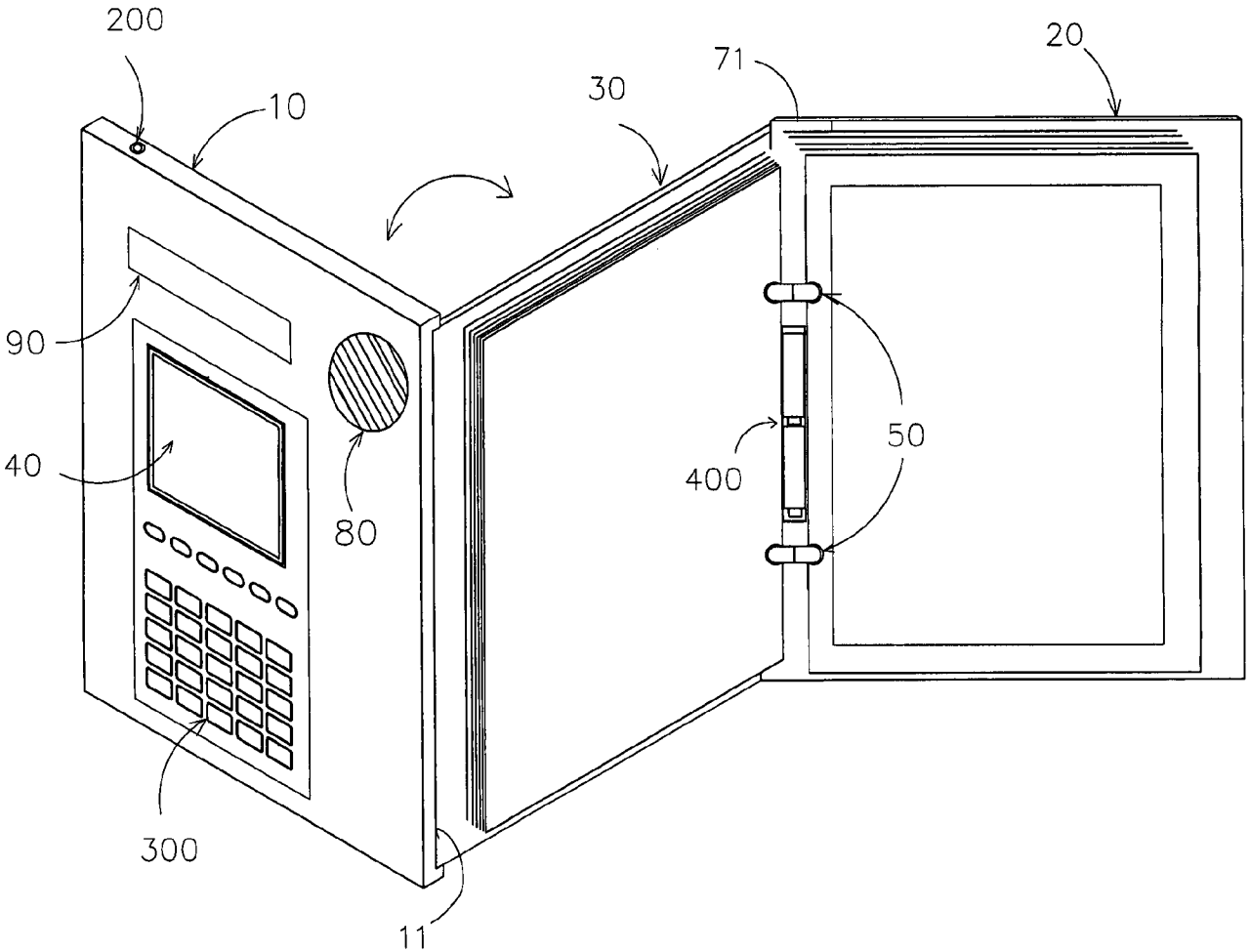
FIG. 4 is a perspective view of the information book according to the above preferred embodiment of the present invention, illustrating the unfolding structure of the front cover, back cover, and the middle panel for being folded in tri-fold manner.
Figure 5:
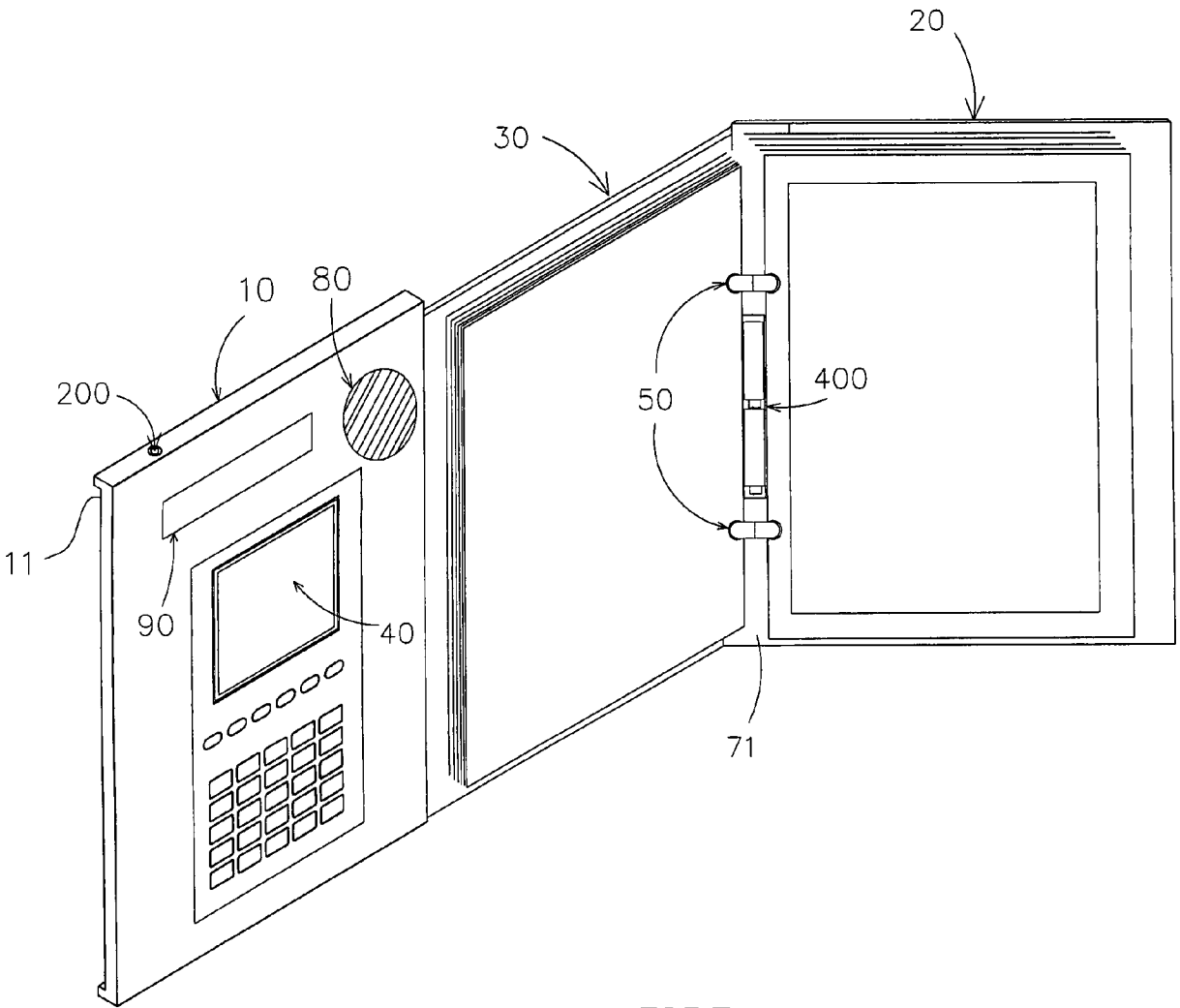
FIG. 5 is perspective view of the information book according to the above preferred embodiment of the present invention, illustrating the front cover, the back cover, and the middle panel adapted for being folded at a plane position.

Referring to FIGS. 3 to 5 of the drawings, an information book according to a preferred embodiment is illustrated. The information book comprises a booklet casing for holding a PDA 40 in position, wherein the booklet casing comprises a front cover 10, a back cover 20 overlappedly folded thereto and at least a middle panel 30 foldably extended between the front and back covers 10, 20. The booklet casing is adapted to fold at a storage position that the middle panel 30 is overlappedly folded between the front and back covers 10 in a tri-fold manner and at an expanded position that the front cover 10, the back cover 20 and the middle panel 30 are aligned edge-to-edge at a plane manner. The front cover 10 and the back cover 20 differs from a conventional book cover is that each of the front and back covers 10, 20 has a cavity. According to the preferred embodiment of the present invention, the front cover 10 and the back cover 20 are made by plastic injection to form a hollow structure. The front cover 10 further has an inner indented side 11 defining a receiving cavity thereat wherein the middle panel 30 is folded in the receiving cavity within the inner indent side 11 at the storage position. The PDA 40 is mounted at the front cover 10. For convenience, the PDA 40 is detachably mounted at the front cover 10 via a mounting arrangement. As shown in FIG. 2A, the front cover 10 further has a PDA window 13 and defines a window frame 15 at a peripheral edge of the PDA window 13. The PDA window 13 is a through window for communicating the outer side of the front cover 10 with the inner indented side 11 thereof. The mounting arrangement preferably comprises three pairs of metal made PDA connectors 14 movably provided at the window frame 15 along an upper edge and a lower edge of the PDA window 13 in a reciprocating manner to detachably couple with the PDA 40 in operatively communicating manner. As shown in FIGS. 2B and 2C, each of the PDA connectors 14 comprises an elongated mounting head 141, an elongated holding tail 142 and an enlarged supporting base 143 integrally extended between the mounting head 141 and the holding tail 142. The mounting arrangement further contains a plurality of guiding slots 151 spacedly formed on the upper and lower edges of the PDA window 13 for the mounting heads 141 slidably passing through the guiding slots 151 respectively. The mounting arrangement further comprises a plurality of resilient elements 17 and a plurality of metal made connector seats 16 mounted in the front cover 10 and aligned with the guiding slots 151 respectively, wherein each of the connector seats 16 has a seating slot 161 for the respective resilient element 17 disposed therein. The seating slots 161 of the connector seats 16 are aligned with the guiding slots 151 of the window frame 15. Accordingly, the holding tail 142 of each of the PDA connectors 14 is slidably disposed in the seating slot 161 of the respective connector seat 16 to engage with the resilient element 17 such that the resilient element 17 applies an urging force against the supporting base 143 to push the mounting head 141 within the PDA window 13 through the guiding slot 151. Preferably, the resilient element 17 is a compression spring coaxially engaging with the holding tail 142 of the PDA connector 14. In other words, the mounting head 141 of each of the PDA connectors 14 is adapted to push into the window frame 15 to compress the resilient element 17 and is automatically push out of the window frame 15 by the pushing force of the resilient element 17. It is worth to mention that the supporting base 143 is blocked at the circumferential edge of the guiding slot 151 when the mounting head 141 is pushed by the resilient element 17 so as to prevent the PDA connector 14 being slid out from the window frame 15. The PDA 40 further has a plurality of corresponding terminal slots 41 spacedly formed along a top edge and a bottom edge, wherein the mounting heads 141 of the PDA connectors 14 are slidably engaged with the terminal slots 41 of the PDA 40 to detachably retain the PDA 40 at the PDA window 13 of the front cover 10. By pressing the mounting heads 141 of the PDA connectors 14 into the window frame 15 to disengage with the terminal slots 41 of the PDA 40, the PDA 40 can be easily detached from the front cover 10. It is worth to mention that the PDA connectors 14 are provided in pairs and are symmetrically provided at the window frame 15 such that the PDA 40 is adapted to mount on the front cover 10 either facing the outer side or the inner side thereof. Therefore, the user is able to detachably mount another PDA 40 to the front cover 10 of the booklet casing or to detachably mount the PDA 40 to another booklet casing for enhancing the practice use of the present invention.

As shown in FIG. 4 of the drawings, the PDA 40 can be utilized by a controlling keyboard 300. The controlling keyboard 300 is installed on the front cover 10 and is electrically connected to the PDA 40 via a circuit board 100 to allow an operatively communication with the PDA 40.

Figure 6:
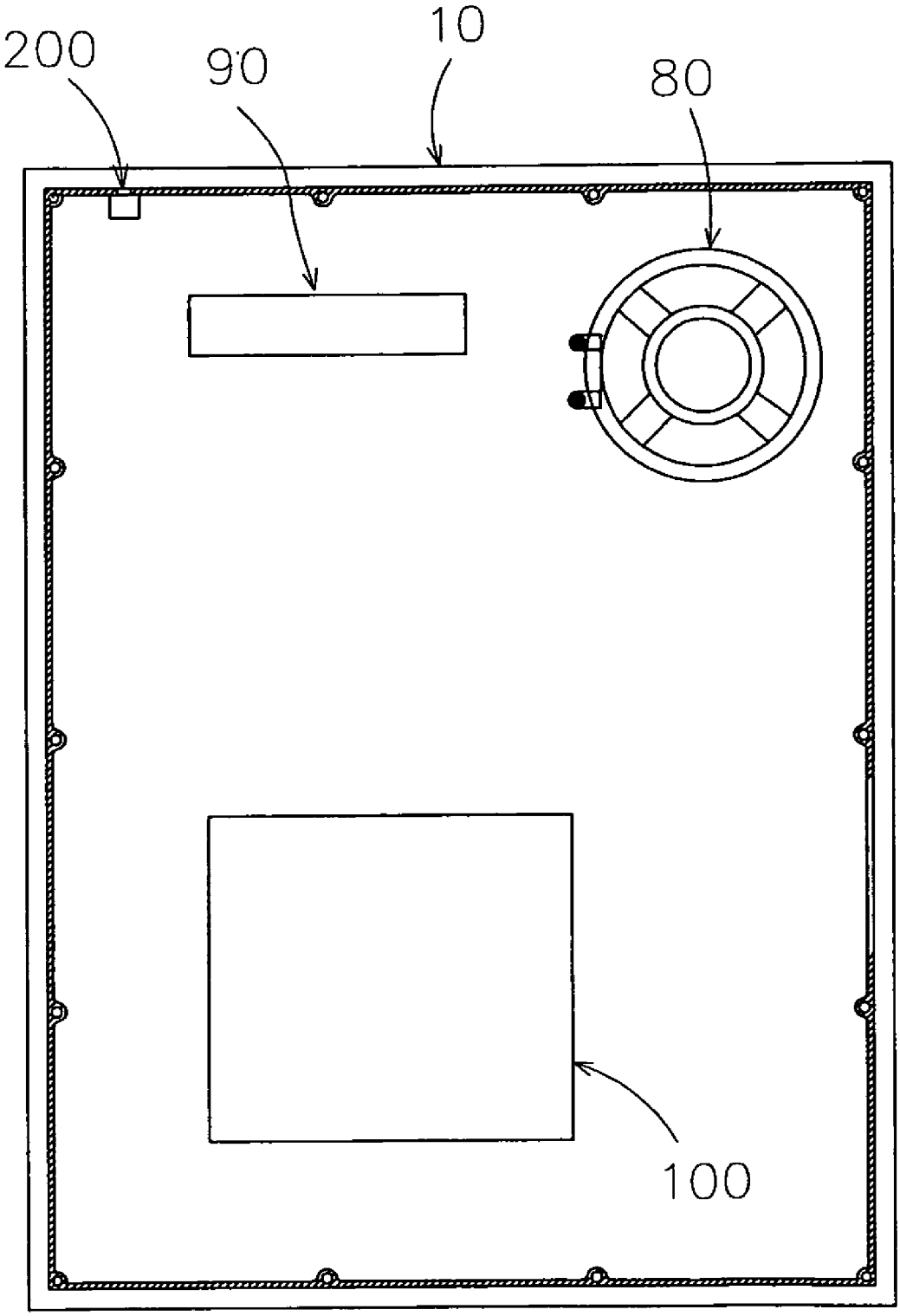
FIG. 6 is a rear view of the front cover of the information book according to the above preferred embodiment of the present invention, illustrating the PDA communication device on the front cover.
Figure 7D:
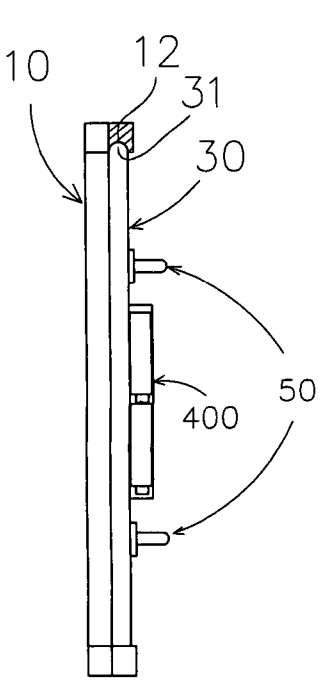
FIG. 7D is a side view of the front cover and middle panel according to the above preferred embodiment of the present invention, illustrating the middle panel received in the receiving cavity of the front cover.
Figure 7C:
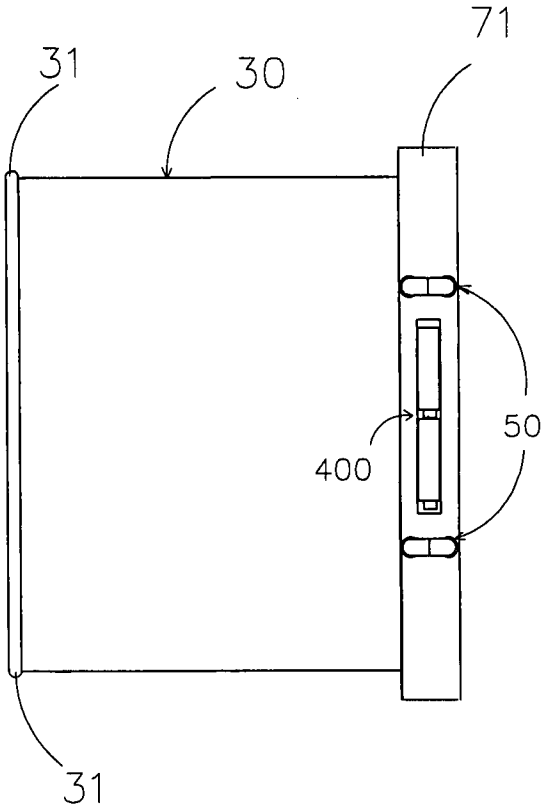
FIG. 7C is a front view of the middle panel of the information book according to the above preferred embodiment of the present invention.
Figure 7B:
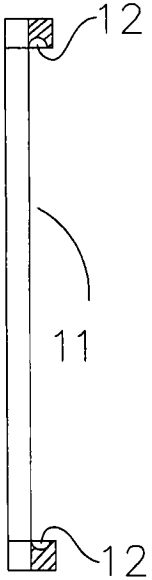
FIG. 7B is a side view the front cover according to the above preferred embodiment of the present invention.
Figure 7A:
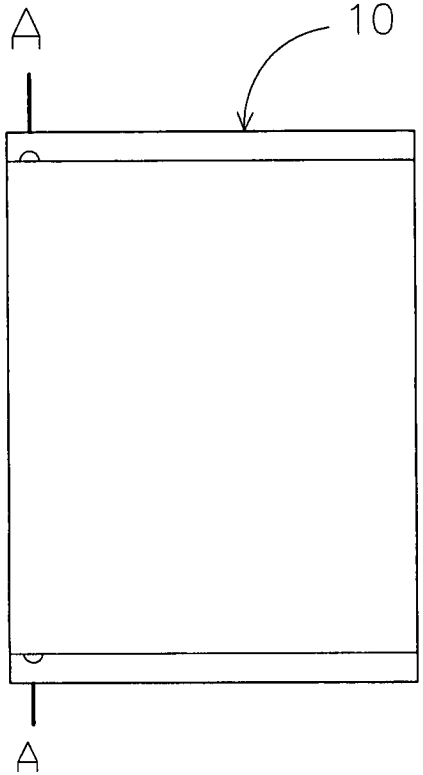
FIG. 7A is a rear view of the front cover according to the above preferred embodiment of the present invention.

As shown in FIGS. 3 to 6, the middle panel 30 is pivotally connected with the front cover 10 via a pivot hinge. As shown in FIGS. 7A, 7B, and 7C, the pivot hinge contains two pivot slots 12 formed at upper and lower rims of the receiving cavity of the front cover 10 and comprises two pivot axes 31 which are protruded from upper and lower corner edges of the middle panel 30 and are fitted into the pivot slots 12 of the front cover 10 respectively such that the middle panel 30 is adapted to pivotally and overlappedly fold into the receiving cavity at a position between the upper and lower rims of the front cover 10 to form a single panel structure as shown in FIG. 7D and pivotally fold at 180 degrees to align with the front cover 10 edge-to-edge at a plane manner. As shown in FIGS. 3, 4 and 5, an elongated jointing strip 71 is connected between edges of the middle panel 30 and the back cover 20 such that the middle panel 30 is adapted to overlappedly fold to the back cover 20. Accordingly, the jointing strip 71 is made of soft fabric material such as cloth or plastic such that the jointing strip 71 provides a flexible connection between the middle panel 30 and the back cover 20. A binding element 50 is provided between the middle panel 30 and the back cover 20 along the jointing strip 71 for detachably binding writing sheets, pictures, and/or picture holding sheets. It is worth to mention that a depth of the receiving cavity of the front cover 10 is equal to a thickness of the middle panel 30 such that the middle panel 30 fits into the receiving cavity of the front cover 10 at the indented side 11 thereof to minimize an overall thickness of the information book at the storage position.

In order to conveniently allow the user to listen to the audio signal from the PDA 40, a speaker 80 is installed on a front side of the front cover 10. The speaker 80 is connected to the PDA 40 via conventional audio signal cables. A computer communication terminal 200 is provided at a peripheral edge of the front cover 10 for electrically communicating with an external computer device via any conventional data transfer cable such that the mounted PDA 40 is capable to communicate with any external computer devices. The front cover 10 further comprises a light source 90 for providing illumination, wherein the light source 90 comprises a LED, mini light tube or light bulb. The light source 90 is electrically connected to the circuit board 100 so as to provide light for the user to use the PDA or booklet casing under a dark environment. A power source 400, provided on the jointing strip 71, comprises a battery holder or any other conventional power source and is electrically connected to the circuit board 100 so as to provide the electrical power for the lighting source 90 and/or the speaker 80 as shown in FIG. 6 of the drawings. A battery having larger capacity can be installed in the power source 400 to provide a longer usage time for the information book.

Figure 8A:
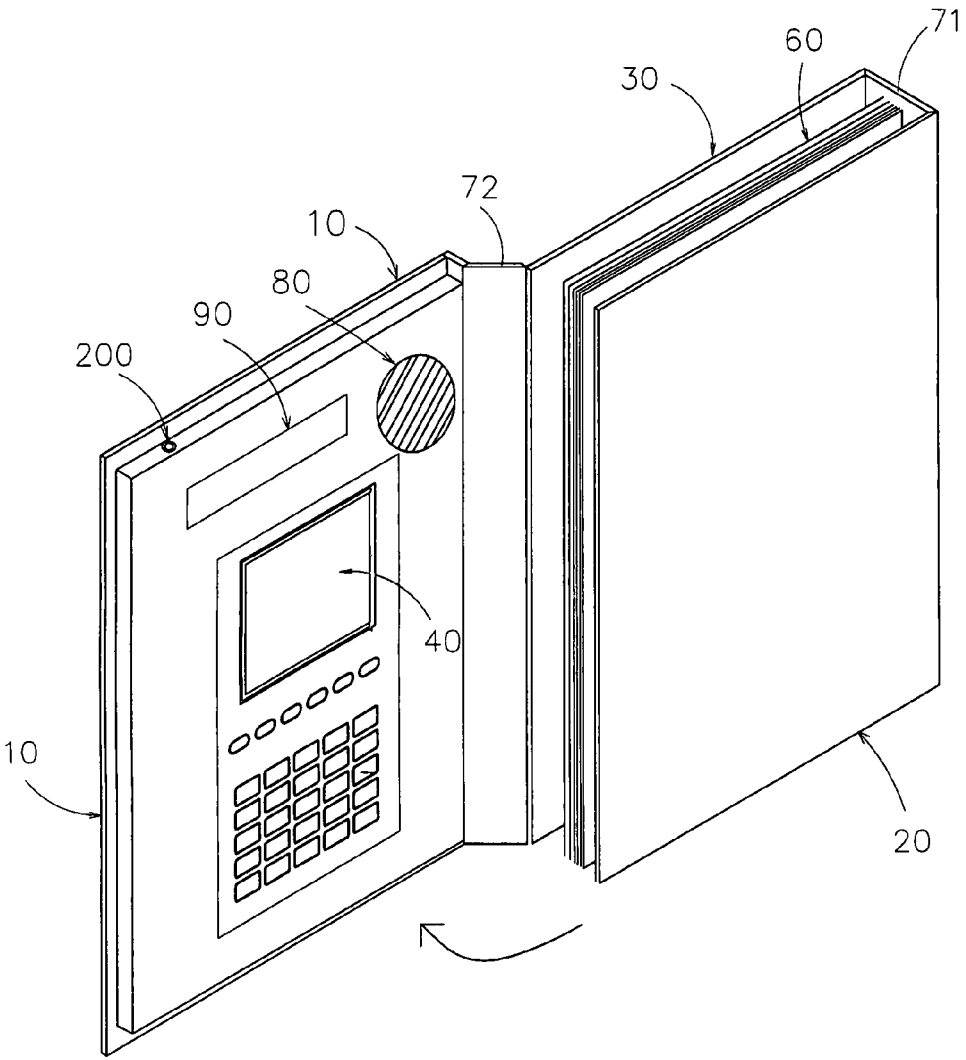
Figure 8B:
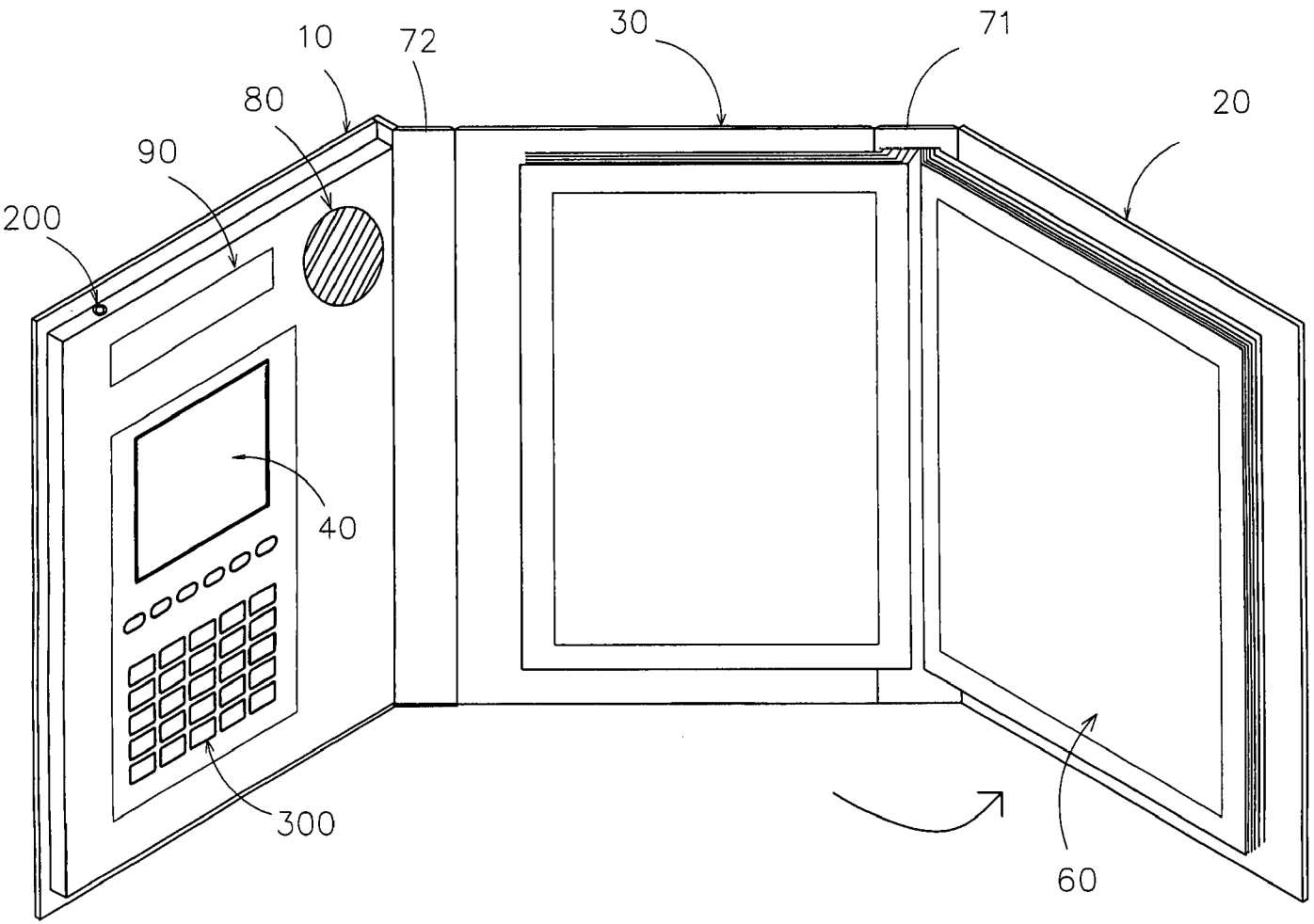

FIGS. 8A and 8B illustrates an alternative mode of the information book, wherein the alternative mode has the same structural configuration of the above embodiment, expect the connection between the front cover 10 and the middle panel 30.

As it is mentioned above, the middle panel 30 is foldably connected to the back cover 20 via the jointing strip 71. According to the alternative mode, an additional jointing strip 72 is foldably connected between edges of the front cover 10 and the middle panel 30. Information sheets 60, such as pictures, writing sheets or picture holding sheets, are attached to the jointing strip 71 via conventional binding methods that edges of the information sheets 60 are bound at the jointing strip 71 for various purposes such as reading or writing.

What is claimed is:

1. An information book for a PDA, comprising a booklet casing which comprises a front cover, a back cover, and at least a middle panel foldably extended between said front and back covers, wherein said booklet casing is folded between a storage position that said front cover, said middle panel, and said back cover are overlappedly folded in a tri-fold manner and an expanded position that said front cover, said middle panel, and said back cover are aligned edge-to-edge in a plane manner, wherein said front cover has an inner indented side defining a receiving cavity therein such that when said middle panel is folded to said front cover, said middle panel is fittedly received in said indented side of said front cover, wherein said booklet casing further comprises a binding element provided between said middle panel and said back cover along a folding line thereof for detachably binding at least an information sheet between said middle panel and said back cover.

2. The information book, as recited in claim 1, wherein said booklet casing further comprises a pivot hinge and a jointing strip, wherein said pivot hinge contains two pivot slots formed at upper and lower rims of said receiving cavity of said front cover and comprises two pivot axes which are protruded from upper and lower corner edges of said middle panel and are fitted into said pivot slots of said front cover respectively so as to pivotally connect said middle panel with said front cover, wherein said jointing strip, which is made of soft and flexible material, is connected between edges of said middle panel and said back cover such that said middle panel is overlappedly folded on said back cover through said jointing strip.

3. The information book, as recited in claim 1, wherein said booklet casing further comprises two jointing strips for joining said front cover, said middle panel, and said back cover, wherein one of said jointing strips is connected between edges of said middle panel and said front cover and another said jointing strip is connected between edges of said middle panel and said back cover such that said front cover, said middle panel, and said back cover are adapted to be overlappedly folded in a tri-fold manner.

4. The information book, as recited in claim 1, wherein said front cover has a hollow structure, wherein a speaker is mounted at said front cover for operatively connecting with said PDA.

5. The information book, as recited in claim 1, further comprising a light source, provided at said front cover, a circuit board which is supported in said front cover and is electrically connected to said light source, and a power source which is supported by said booklet casing and is electrically connected to said circuit board.

6. The information book, as recited in claim 1, further comprising a computer communication terminal which is provided at a peripheral edge of said front cover and is adapted for electrically connecting to said PDA so as to communicatively connect said PDA with an external computer device via said computer communication terminal.

7. The information book, as recited in claim 1, further comprising a controlling keyboard provided on said front cover for controllably connecting to said PDA and a circuit board which is provided in said front cover and is electrically connected to said controlling keyboard.

8. The information book, as recited in claim 1, wherein said front cover is adapted for said PDA detachably mounting thereto.

9. The information book, as recited in claim 8, wherein said front cover has a PDA window, wherein said booklet casing further comprises a mounting arrangement for detachably mounting said PDA within said PDA window, wherein said mounting arrangement contains a plurality of terminal slots spacedly formed along a top edge and a bottom edge of said PDA and comprises at least two pairs of PDA connectors movably provided along an upper edge and a lower edge of said PDA window in a reciprocating manner, wherein said PDA connectors are slidably fit to said terminal slots for detachably locking said PDA within said PDA window.

10. The information book, as recited in claim 9, wherein each of said PDA connectors comprises an elongated mounting head, an elongated holding tail and an enlarged supporting base integrally extended between said mounting head and said holding tail, wherein said mounting arrangement further contains a plurality of guiding slots spacedly formed on said upper and lower edges of said PDA window for said mounting heads slidably passing through said guiding slots respectively, wherein said mounting arrangement further comprises a plurality of resilient elements and a plurality of connector seats mounted in said front cover and aligned with said guiding slots respectively, wherein each of said connector seats has a seating slot for said respective resilient element disposed therein, wherein said seating slots of said connector seats are aligned with said guiding slots of said window frame, wherein said holding tail of each of said PDA connectors is slidably disposed in said seating slot of said respective connector seat to engage with said resilient element such that said resilient element applies an urging force against said supporting base to push said mounting head within said PDA window through said guiding slot so as to insert said mounting head into said terminal slot for mounting said PDA within said PDA window.

* * * * *